US010690109B2

(12) United States Patent
Costaz et al.

(10) Patent No.: US 10,690,109 B2
(45) Date of Patent: Jun. 23, 2020

(54) DISTRIBUTION DEVICE FOR A HYDRAULIC MACHINE AND A HYDRAULIC MACHINE FITTED WITH SUCH A DEVICE

(71) Applicant: POCLAIN HYDRAULICS INDUSTRIE, Verberie (FR)

(72) Inventors: Dominique Costaz, Verberie (FR); Loic Bonnard, Verberie (FR); Julien Viard, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 272 days.

(21) Appl. No.: 15/340,363

(22) Filed: Nov. 1, 2016

(65) Prior Publication Data

US 2017/0130693 A1 May 11, 2017

(30) Foreign Application Priority Data

Nov. 10, 2015 (FR) ..... 15 60767

(51) Int. Cl.
*F03C 1/32* (2006.01)
*F03C 1/40* (2006.01)
(Continued)

(52) U.S. Cl.
CPC ..... *F03C 1/0457* (2013.01); *F03C 1/045* (2013.01); *F03C 1/0415* (2013.01);
(Continued)

(58) Field of Classification Search
CPC ..... F03C 1/0457; F03C 1/045; F03C 1/0415; F03C 1/0472; F04B 1/10; F04B 1/063;
(Continued)

(56) References Cited

U.S. PATENT DOCUMENTS 3,139,109 A * 6/1964 Ruchser ..... F15B 20/001 137/596.16
3,536,089 A * 10/1970 Sarbach ..... F16K 11/10 137/116.3
(Continued)

FOREIGN PATENT DOCUMENTS

EP 0 284 460 A1 9/1988
FR 2 127 268 A5 10/1972
(Continued)

*Primary Examiner* — Patrick Hamo
*Assistant Examiner* — David N Brandt
(74) *Attorney, Agent, or Firm* — The Webb Law Firm

(57) ABSTRACT

The devices comprises a distributor (16) that presents distribution ducts opening out into a radial distribution face (16A), and a distributor-counterpart engaged in each other in such a manner that two main enclosures (18, 20) are provided between their opposite axially-extending faces. The device comprises a cylinder-capacity selector comprising two slides (24, 26) arranged after the other in a bore (22) of the element engaged in the other, to which are connected the main enclosures (18, 20) and at least some of the distribution ducts (30, 31). The slides are able to adopt at least three distinct configurations establishing different connections between the main ducts (18, 20) and the distribution ducts via the main enclosures, in order to be able to obtain at least three distinct operating cylinder capacities.

28 Claims, 9 Drawing Sheets

(51) Int. Cl.

| | |
|---|---|
| ***F04B 1/04*** | (2020.01) |
| ***F04B 1/06*** | (2020.01) |
| ***F04B 1/10*** | (2006.01) |
| ***F04B 1/20*** | (2020.01) |
| ***F04B 1/22*** | (2006.01) |
| ***F03C 1/047*** | (2006.01) |
| ***F04B 1/0452*** | (2020.01) |
| ***F04B 1/063*** | (2020.01) |
| ***F04B 1/2064*** | (2020.01) |
| ***F04B 1/2035*** | (2020.01) |

(52) U.S. Cl.
CPC ..... *F03C 1/0472* (2013.01); *F04B 1/0452* (2013.01); *F04B 1/063* (2013.01); *F04B 1/10* (2013.01); *F04B 1/2035* (2013.01); *F04B 1/2064* (2013.01); *F04B 1/22* (2013.01)

(58) Field of Classification Search
CPC .... F04B 1/0452; F04B 1/2064; F04B 1/2035; F04B 1/22; F04B 1/0456; F16K 11/10
See application file for complete search history.

(56) References Cited

U.S. PATENT DOCUMENTS 3,621,760 A * 11/1971 Goode ..... F03C 1/02 91/188
3,808,951 A 5/1974 Martin
3,949,645 A * 4/1976 Masclet ..... B64C 25/26 91/459
4,259,986 A * 4/1981 Maucher ..... F15B 13/015 137/596.12
4,616,674 A * 10/1986 Bardoll ..... F15B 13/042 137/596.16
5,001,964 A * 3/1991 Allart ..... F03C 1/045 60/420
9,903,396 B2 * 2/2018 Brinkman ..... F15B 13/0832
2011/0193000 A1 * 8/2011 Miyazoe ..... F15B 11/064 251/129.01
2014/0346258 A1 * 11/2014 Stucchi ..... F16K 31/008 239/583
2016/0032908 A1 * 2/2016 Viard ..... F04B 1/0421 91/491
2017/0122285 A1 * 5/2017 Bonnard ..... F04B 1/0456
2017/0248241 A1 * 8/2017 Viard ..... F04B 1/047
2017/0348773 A1 * 12/2017 Bonnard ..... B23B 5/08

FOREIGN PATENT DOCUMENTS

FR 2 481 755 A1 11/1981
GB 2 253 658 A 9/1992

* cited by examiner

DISTRIBUTION DEVICE FOR A HYDRAULIC MACHINE AND A HYDRAULIC MACHINE FITTED WITH SUCH A DEVICE

CROSS-REFERENCE TO RELATED APPLICATION(S)

This patent application claims the benefit of priority under 35 U.S.C. § 119 to French Patent Application No. 1560767, filed on Nov. 10, 2015, the entirety of which is incorporated herein by reference.

FIELD OF THE INVENTION

The present description relates to a distribution device for a hydraulic machine comprising a distributor that presents distribution ducts opening out into a radial distribution face, and a distributor-counterpart, one of the elements constituted by the distributor and by the distributor-counterpart being engaged in the other of said elements, in such a manner that said elements present respective opposite axially-extending faces between which first and second main enclosures are provided, the device comprising cylinder-capacity selection means suitable for defining at least three distinct operating cylinder capacities, by connecting the distribution ducts selectively to first or second main feed or discharge ducts via the main enclosures.

BACKGROUND

Conventionally, the distributor-counterpart is a non-rotary part through which the fluid passes, in particular for feeding and discharging, before reaching the distributor, which distributes said fluid among the various distribution ducts that are put into communication one after the other with the cylinders of the cylinder block of the hydraulic machine. By way of example, for a stationary casing and rotary cylinder block machine, the distributor-counterpart is a casing portion; by way of example, for a rotary casing and stationary cylinder block machine, the distributor-counterpart is a stationary core.

Document EP 0 284 460 describes a pressurized fluid mechanism (motor or pump) having three operating cylinder capacities and having a distributor, which is an internal distributor, that presents a radial distribution face. That mechanism comprises two cylinder-capacity selectors, each arranged in the casing portion of the distribution device and each suitable for being controlled separately. That mechanism gives satisfaction, but it presents two drawbacks. Firstly, its radial size is considerable since it needs to be able to house two cylinder-capacity selection slides in two different bores that are provided in the casing portion of the distribution device. Secondly, it requires a distributor and a distributor-counterpart that are very specific, which must be specially provided for that mechanism, without either of them being suitable for use in a mechanism having only one cylinder-capacity or only two cylinder-capacities. Thus, for that mechanism it is not possible to make use of a simpler distributor or distributor-counterpart, as used for other mechanisms. However, although it is conventional for each mechanism of the type described in EP 0 284 460 to provide a specific internal distributor adapted to the looked-for after functions, it is desirable for reasons of economy of production to be able to maximize use of the same distributor-counterpart for other mechanisms (which distributor-counterpart is specifically a casing portion surrounding the internal distributor), regardless of their numbers of cylinder capacities.

Document FR 2 127 268 also discloses a hydraulic mechanism having three operating cylinder capacities. In that mechanism, a cylinder-capacity selection device is arranged in the distributor, which is an internal distributor. That mechanism comprises a slide that is capable of adopting three positions: a first position obtained by feeding a first control chamber with fluid; a second position obtained by feeding another control chamber opposite the first; and a third position obtained without feeding the control chambers, but under the effect of the return spring. That mechanism makes it possible to overcome the above-mentioned problem in part since the cylinder-capacity selection device is arranged in the internal distributor. However, the shape of the cylinder-capacity selection slide is complex. In addition, the distribution ducts provided in the internal distributor are complex in shape, so that the ducts can open out in the proximity of one another in the various regions of the bore in which the single cylinder-capacity selection slide moves. Thus, it is a mechanism in which the distribution face is an outer axially-extending face of the internal distributor, said internal distributor being inserted like a core inside the cylinder block. Because of the complexity of the shape of the distribution ducts, that mechanism does not seem compatible with a distributor having a radial distribution face. Consequently, the mechanism also needs to be of considerable size radially and, de facto, it is usable only with axial distribution face technology, which presents certain drawbacks, in particular in terms of sealing between the axial distribution face and the axial communication face of the cylinder block into which the cylinder ducts open out in order to be put into communication with the distribution ducts.

SUMMARY

Thus, in one aspect, the invention relates to a distribution device for a hydraulic machine comprising a distributor that presents distribution ducts opening out into a radial distribution face, and a distributor-counterpart, one of the elements constituted by the distributor and by the distributor-counterpart being engaged in the other of said elements, in such a manner that said elements present respective opposite axially-extending faces between which a first and a second main enclosure are provided, the device comprising cylinder-capacity selection means suitable for defining at least three distinct operating cylinder capacities, by connecting the distribution ducts selectively to a first or a second main feed or discharge duct via the main enclosures; in said device, the cylinder-capacity selection means comprise first and second slides arranged one after the other in a bore of one of the elements constituted by the distributor and by the distributor-counterpart, which bore is connected to the main enclosures and to at least some of the distribution ducts, the slides being configured to adopt at least three distinct configurations establishing different connections between the main ducts and the distribution ducts via the main enclosures.

In this aspect, two slides are arranged in the same bore of the distributor or of the distributor-counterpart. Each of these two slides may itself be relatively small, and they are easy to control respectively. In addition, the portion (distributor-counterpart or distributor) other than that in which said bore is provided, is not concerned by the cylinder-capacity selection means, in such a manner that a single "standard" portion may be used for different types of hydraulic machine, optionally with a plurality of cylinder capacities. Finally, said device is compatible with a distributor of the "faceplate" type in which the distribution face is radial, and thus thrusts axially against the communication face of the cylinder block, in such a manner as to ensure the sought-after sealing. This device may thus be used for hydraulic machines that remain radially compact, while keeping production costs under control and ensuring the required reliability.

Optionally, the bore is arranged axially and the slides are movable axially in order to define said distinct configurations.

This further promotes radial compactness of the device and of the hydraulic machine fitted with the device.

Optionally, the bore is formed in that one of the elements constituted by the distributor and by the distributor-counterpart that is engaged in the other one of said elements.

Optionally, the bore is central.

In this configuration, the internal distributor may be generally in the form of a body of revolution about its axis, which is the axis of rotation of the rotor of the hydraulic machine fitted with the device.

Optionally, the device includes a spring, arranged between the opposite faces of the two slides for permanently biasing relative movement of the slides, in particular for moving the slides apart from one another, and control means for selectively controlling a controlled movement of each slide in the opposite direction to said relative movement for the slide under consideration.

Arranging the spring between the two slides is one option for promoting compactness and reliability of the control.

Optionally, the spring is arranged in a zone of the bore that is connected to a leak return duct.

This option avoids, excess pressure in the bore zone in which the spring is arranged, thereby making it easier to control movement of the slides in the direction opposite the return force exerted by the spring, and reducing the response time.

Optionally, for each slide, the device includes an abutment that is suitable for co-operating with the slide under consideration, in order to limit the movement of said slide in said opposite direction, regardless of the position of the other slide.

In this optional configuration, the movements under consideration of the two slides may be totally independent and four relative positions may be obtained, and therefore four operating cylinder capacities, as described below.

Optionally, the control means comprise a first control chamber for the first slide and a second control chamber for the second slide, said control chambers being suitable for being fed with fluid in order to control selectively said controlled movement of each slide.

Thus, in order to control the selective movements of the two slides in three or even four relative positions, it suffices to have two control chambers in association with a resilient return opposing the feeding of liquid to the chambers. In other words, the hydraulic control means for controlling movement of the slides may thus comprise only a first chamber associated with the first slide and a second chamber associated with the second slide, without requiring other hydraulic control chambers.

Optionally, the control chambers are arranged at the respective ends of the slides, opposite the spring.

In this configuration, two hydraulic control chambers and a spring suffice to control the slides between their three relative positions, or even between their four relative positions.

Optionally, the distributor is engaged in the distributor-counterpart that forms a casing portion of the device.

The distributor thus forms an internal distributor.

Optionally, the first and second slides are arranged in respective first and second segments of the bore, each presenting a first distribution groove connected to the first main enclosure and a second distribution groove connected to the second main enclosure; each of the first and second segments of the bore presenting a connection groove suitable for being connected to one or the other of the first and second distribution grooves of the segment under consideration depending on the position of the slide situated in said segment;

and, among the distribution ducts, distinct groups of distribution ducts are connected respectively to the connection grooves and to the distribution grooves.

Optionally, the distributor is stationary (i.e. constrained not to move in rotation), the bore is formed in the distributor, and the first distribution grooves are connected to each other by a first hole in the distributor and the second distribution grooves are connected to each other by a second hole in the distributor.

In this optional configuration, the distributor-counterpart may be a standard part, being just as suitable for machines with a plurality of cylinder capacities as for machines having a single cylinder capacity.

Optionally, the distributor is stationary (i.e. constrained not to move in rotation), the bore is formed in the casing portion in which the distributor is engaged, and the first distribution grooves are connected to each other by a first hole in the distributor, and the second distribution grooves are connected to each other by a second hole in said casing portion.

In this configuration, it is the distributor that may be a standard part, being just as suitable for machines with a plurality of cylinder capacities as for machines having a single cylinder capacity.

Optionally, the first and second slides are arranged in respective first and second segments of the bore, each presenting a first distribution groove connected to the first main duct and a second distribution groove connected to the second main duct, each of the first and second segments of the bore presenting a connection groove suitable for being connected to one or the other of the first and second distribution grooves of the segment under consideration depending on the position of the slide situated in said segment, and, among the distribution ducts, distinct groups of distribution ducts are connected respectively to the connection grooves and to the distribution grooves.

Optionally, the distributor is rotary, the bore is formed in the distributor-counterpart, which is engaged in the distributor, and the first distribution grooves are connected to each other by a first hole in the distributor-counterpart connected to the first main duct and the second distribution grooves are connected to each other by a second hole in the distributor-counterpart connected to the second main duct.

Optionally, first and second secondary enclosures, provided between the axially-extending faces opposite the distributor and the distributor-counterpart, are connected respectively to first and second connection grooves.

Optionally, for each of the first and second segments of the bore, the connection groove is situated between the first and second distribution grooves, and each of the first and second slides presents a communication groove in order to put the connection groove into communication with the first or the second distribution groove depending on the position of the slide.

Optionally, the distribution ducts are distributed in first and second primary groups, first and second secondary groups, and first and second tertiary groups, and the cylinder-capacity selection means are suitable for defining:

- a first cylinder capacity in which the distribution ducts of the first primary, secondary, and tertiary groups are connected to the first main duct while the distribution ducts of the second primary, secondary, and tertiary groups are connected to the second main duct;
- a second cylinder capacity in which the distribution ducts of the first primary and secondary groups are connected to the first main duct, the distribution ducts of the second primary and secondary groups are connected to the second main duct, and the distribution ducts of the first and second tertiary groups are connected to each other; and
- a third cylinder capacity in which the distribution ducts of the first primary group are connected to the first main duct, the distribution ducts of the second primary group are connected to the second main duct, and the distribution ducts of the first and second secondary groups are connected to each other and the distribution ducts of the first and second tertiary groups are connected to each other.

Optionally, the cylinder-capacity selection means are further suitable for defining:

- a fourth cylinder capacity in which the distribution ducts of the first primary and tertiary groups are connected to the first main duct, the distribution ducts of the second primary and tertiary groups are connected to the second main duct, and the distribution ducts of the first and second secondary groups are connected to each other.

Optionally, in the cylinder capacities in which the distribution ducts of the first and second secondary groups and/or the distribution ducts of the first and second tertiary groups are connected to each other, said distribution ducts are connected to the second main duct.

Where appropriate, the above-mentioned connections to the first and/or second main duct(s) may be made via the main enclosures.

Optionally, the distribution ducts of the second primary, secondary, and tertiary groups are connected to each other, regardless of the configuration of the slides.

Optionally, the distribution ducts of the first primary group are connected to the first distribution groove of at least one of the first and second segments of the bore, the distribution ducts of the second primary, secondary, and tertiary groups are connected to the second distribution groove of at least one of the first and second segments of the bore, the distribution ducts of the first tertiary group are connected to the connection groove of the first segment, and the distribution ducts of the first secondary group are connected to the connection groove of the second segment.

Optionally, the distribution ducts of the first primary group comprise at least one duct opening out into the first distribution groove of the first segment of the bore and at least one duct opening out into the first distribution groove of the second segment of the bore, and/or the distribution ducts of the second primary, secondary, and tertiary groups comprise at least one duct opening out into the second distribution groove of the first segment of the bore and at least one duct opening out into the second distribution groove of the second segment of the bore.

In this configuration, the shape of the distribution ducts in the internal distributor may be simplified since distribution ducts can open out into different zones of the bore while at the same time having the same fluid connections, as a function of the movements of the slides.

BRIEF DESCRIPTION OF THE DRAWINGS

The invention can be well understood and its advantages appear more clearly on reading the following detailed description of embodiments that are shown by way of non-limiting example. The description refers to the accompanying drawings, in which.

DETAILED DESCRIPTION OF EMBODIMENTS

Figure 1:
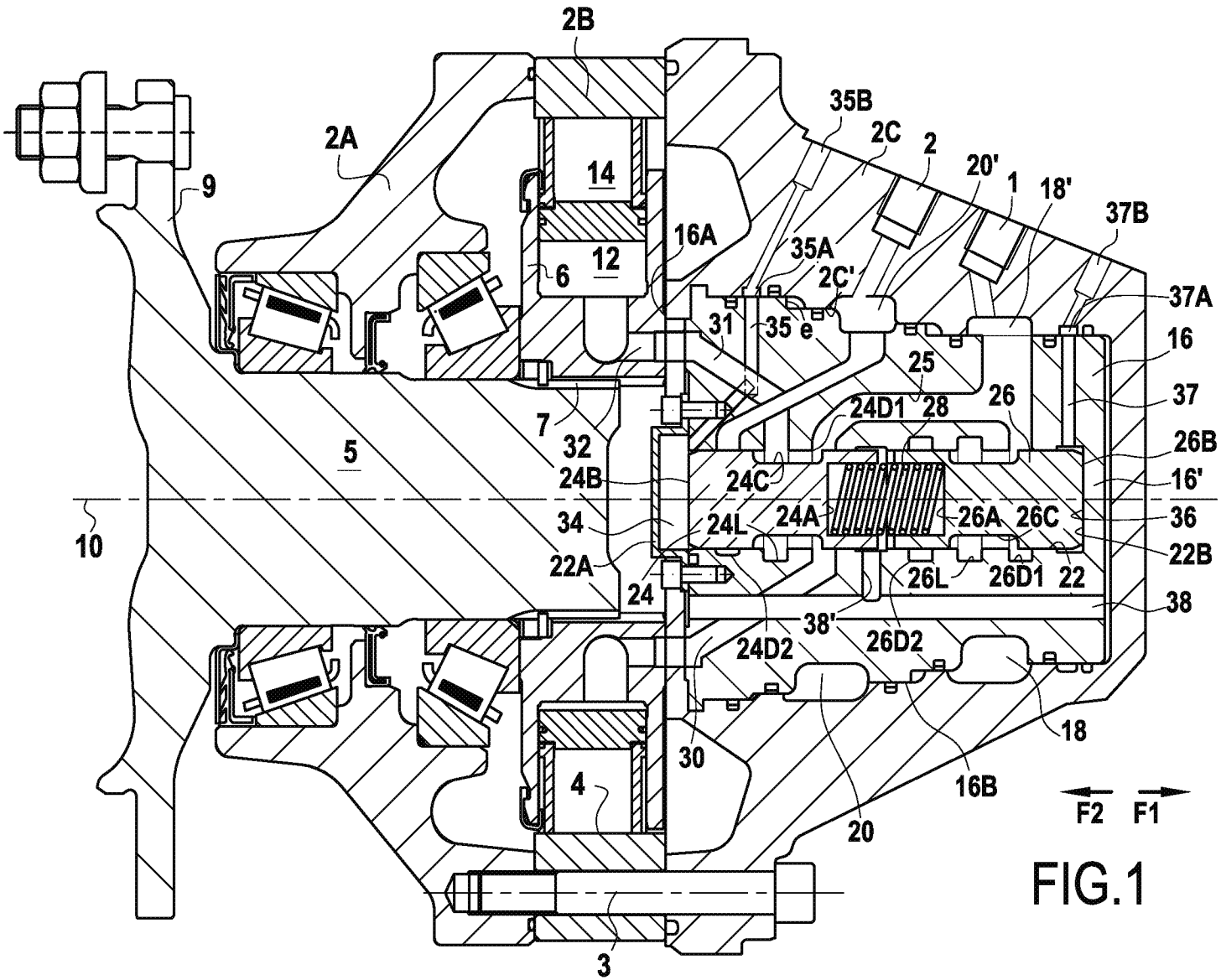
FIG. 1 is an axial section view of a hydraulic machine including a first embodiment of a distribution device of the invention, making it possible to obtain three distinct cylinder capacities and showing the slides of the cylinder-capacity selection means in a first configuration.

The hydraulic machine shown in FIG. 1 is of the type comprising a stationary casing and a rotary cylinder block. Specifically, it is a hydraulic motor or pump machine with radial pistons.

The machine comprises a stationary casing in three portions 2A, 2B, and 2C, assembled together by bolts 3. An undulating reaction cam 4 is made on the portion 2B of the casing. The machine comprises a cylinder block 6 that is mounted to rotate about an axis 10 relative to the cam 4 and that comprises a plurality of radial cylinders 12, suitable for being fed with fluid under pressure; the cylinders having respective radial pistons 14 mounted to slide therein. Specifically, the cylinder block 6 drives in rotation a shaft 5 that co-operates with it via fluting 7. The axis 10 is a central axis through the shaft 5. The shaft carries an outlet flange 9.

The machine further comprises a fluid distributor 16 that is constrained to move in rotation with the casing about the axis 10. In other words, the internal distributor and the cam do not turn relative to each other. The distribution device comprises said distributor 16, which in this configuration is an internal distributor, and the casing portion 2C, in which the internal distributor is housed. This portion 2C of the casing, which is also referred to as the "distribution lid", forms a distributor-counterpart in the meaning of the present invention. This portion 2C may be from a block having the shape of a bell, or it may be closed at its axial end remote from the cylinder block, by a separate plate fitted thereto.

The internal distributor 16 presents a radial distribution face 16A, perpendicular to the axis 10, into which the distribution ducts open out. The internal distributor 16 also presents an outer axially-extending face 16B, that presents a first main groove 18 and a second main groove 20, which grooves serve respectively for fluid feed and fluid discharge, or vice-versa. It is considered below that, in the preferred sense of operating as a motor, the groove 18 is a feed groove and the groove 20 is a discharge groove. The distribution lid 2C has an inner axially-extending face 2C', which faces the outer axially-extending face 16B of the distributor, and which presents main grooves 18' and 20' respectively facing the grooves 18 and 20. These grooves 18' and 20' communicate with main feed and discharge ducts, respectively 1 and 2, which are pierced through the wall of the distribution lid 2C. The grooves 18 and 18' firstly, and the grooves 20 and 20' secondly, form respective first and second main enclosures.

It is specified that the grooves 18' and 20' are the only grooves of the distribution lid 2C serving to feed or discharge fluid with regard to the cylinders. In other words, the distribution lid is of standard type and, to the extent that the cylinder-capacity selector is arranged in the internal fluid distributor as described below, it is not necessary for the distribution lid or the outer axially-extending face of the internal distributor to present other main grooves in order to feed or discharge the cylinders.

The selection means for selecting the cylinder capacity, or "cylinder-capacity selector" comprise an axial bore 22, specifically a bore that is central relative to the axis 10, and two slides, respectively 24 and 26, arranged in said bore. The cylinder-capacity selector also includes a spring 28 arranged between the slides 24 and 26. Specifically, the facing faces of the slides 24 and 26 present recesses, respectively 24A and 26A in which the opposite ends of the spring are housed 28. The spring 28 permanently biases relative movement of the slides. Specifically, it is a compression spring that tends permanently to move the two slides apart from each other; tending to move the slide 24 in the direction F2 and to move the slide 26 in the direction F1.

Distribution ducts are formed in the internal distributor 16. Each distribution duct presents an end that opens into the distribution face 16A in order to be put into communication with a cylinder duct 32 during relative rotation between the cylinder block and the cam. In addition, each distribution duct is connected, either directly or via the cylinder-capacity selector, to one of the main grooves 18 and 20 in order to be connected to the feed or the discharge. Specifically, each of the first and second segments of the bore 22 in which the first slide 24 and the second slide 26 are respectively arranged presents a respective first distribution groove 24D1 or 26D1 that is connected permanently to the first main groove 18 and thus to the first main duct 1, and a respective second distribution groove 24D2 or 26D2 that is connected permanently to the second main groove 20 and thus to the second main duct 2. Specifically, FIG. 1 shows a hole 25 that is provided in the internal distributor 16 and that connects together the distribution grooves 24D1 and 26D1. An analogous hole, (not shown in the diagram of the figure), can connect the distribution grooves 24D2 and 26D2. Each of the first and second segments of the bore 22 in which the slides 20 and 24 are respectively arranged further presents a respective connection groove 24L or 26L that, for each segment, is suitable for being connected to one or the other of the first and second distribution grooves, depending on the position of the slide 26.

The control means for controlling the cylinder-capacity selector comprise a first control chamber 34 for the first slide and a second control chamber 36 for the second slide 26. These chambers are fed with fluid by respective control ducts 35 for the chamber 34, and 37 for the chamber 36. These control ducts are provided by holes in the internal distributor 16, and they open out into respective grooves 35A and 37A of the distribution lid 2C. The lid itself presents holes, respectively 35B and 37B, that open out into said grooves in order to communicate with the control ducts 35 and 37. The holes 35B and 37B are connected to valves (not shown) in order to be selectively connected to a source of fluid under pressure, e.g. booster fluid, or to a pressure-free reservoir, in such a manner as to feed the control chambers or to allow them to be purged.

Sealing gaskets are arranged between the outer axially-extending face 16B of the internal distributor and the inner axially-extending face 2C' of the distribution lid, on either side of the above-mentioned grooves 35A, 20/20', 18/18', and 37A. In addition, these axially-extending faces present shoulders, also arranged between gaskets, such as the shoulder e, for balancing the axial thrust of the internal distributor on the cylinder block, the spaces formed between two opposite shoulders being able to be fed with thrust fluid.

The control chambers 34 and 36 are arranged at the respective ends of the slides. More precisely, the chamber 34 is defined between the end 24B of the slide 24 remote from the cavity 24A and a lid 22A that is fitted on the internal distributor in such a manner as to close the bore 22. The chamber 36 is arranged between the end 26B of the slide 26 remote from the cavity 26A and the opposite end 22B of the bore that is closed by a portion of the end wall 16' of the internal distributor. This end wall portion 16' may be formed by a separate, fitted lid, or by a wall made integrally with the body of the internal distributor 16. In the example shown, the lid 22A is arranged on the end of the distributor that is close to the cylinder block. Naturally, provision could be made for a wall made integrally with the body of the distributor to close the bore at its cylinder block end, and for a fitted lid, such as the lid 22A, to close the bore 22 at its end remote from the cylinder block.

Figure 2:
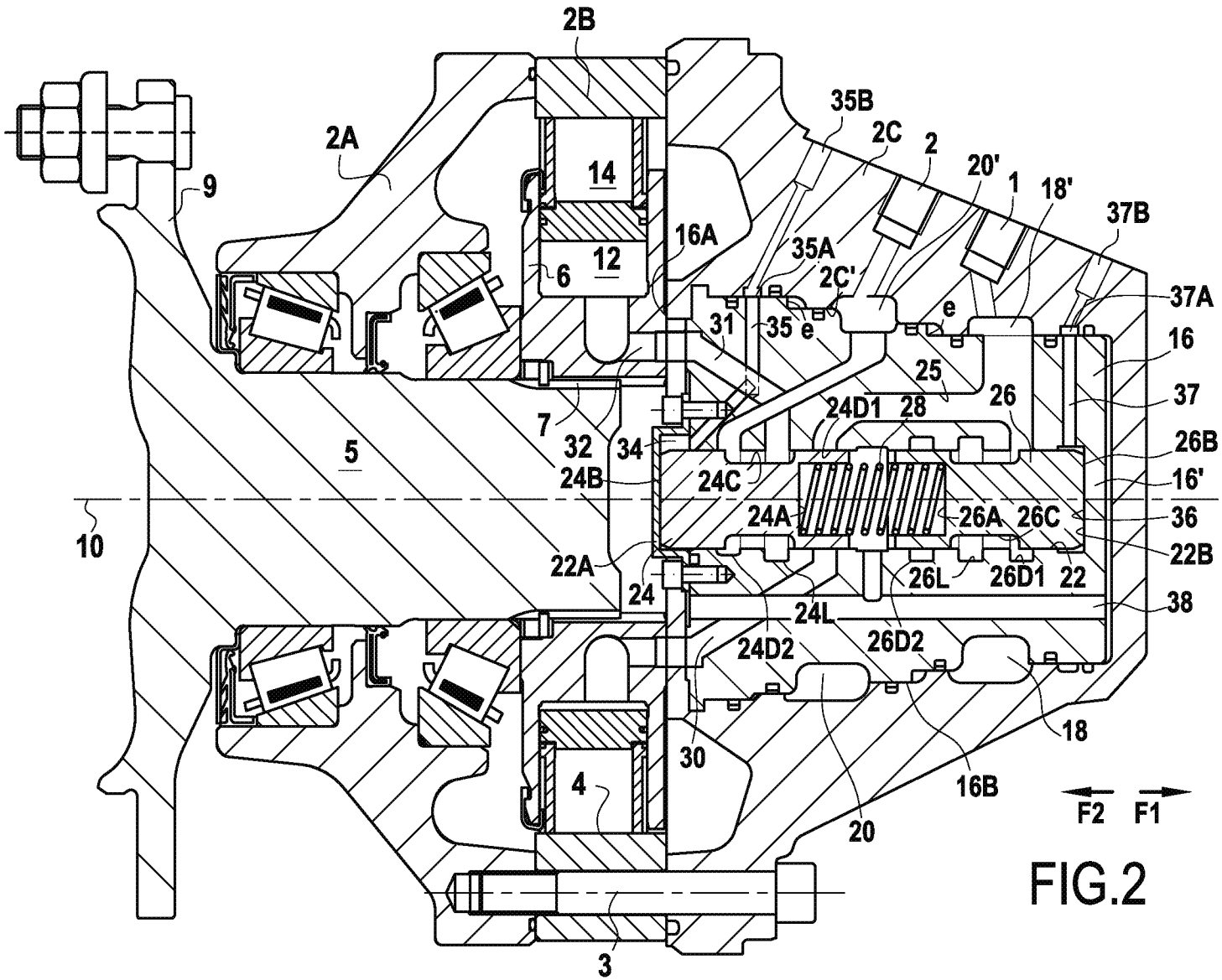
FIGS. 2 and 3 are two axial section views of said machine showing respectively the second and third configurations of the slides.
Figure 3:
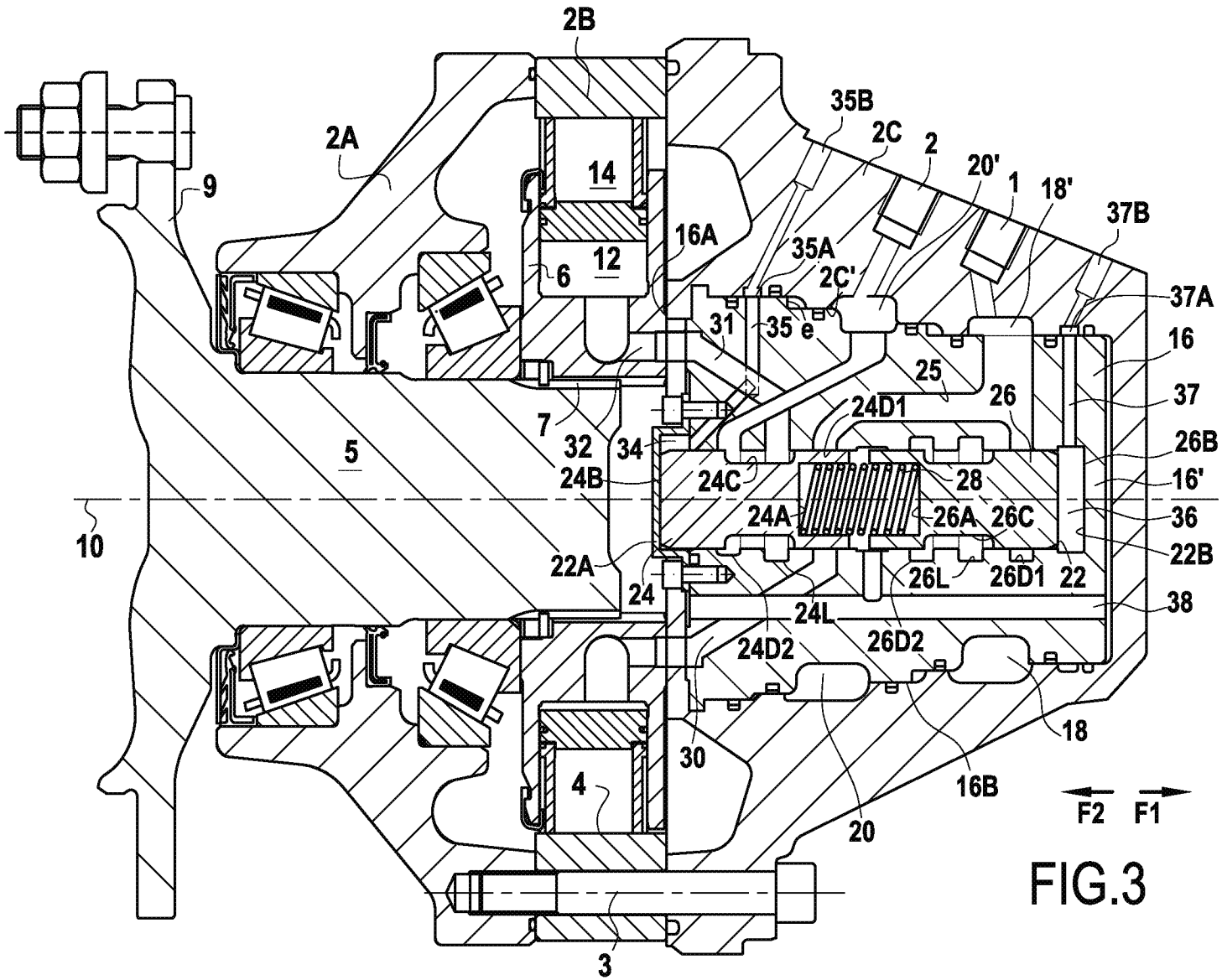

The connection groove 24L of the first segment of the bore 22 is situated between the distribution grooves 24D1 and 24D2 of said segment and, similarly, the connection groove 26L of the second segment is situated between the distribution grooves 26D1 and 26D2 of said segment. In addition, the outer axially extending peripheries of the slides 24 and 26 present communication grooves. More precisely, the outer periphery of the slide 24 presents a communication groove 24C that, depending on the position of said slide, puts the grooves 24L and 24D1 into communication by isolating them from the groove 24D2 (FIG. 1) or indeed puts the grooves 24L and 24D2 into communication by isolating them from the groove 24D1 (FIGS. 2 and 3). In addition, the outer periphery of the slide 26 presents a communication groove 26C that, depending on the position of the slide 26, puts the grooves 26D1 and 26L into communication by isolating them from the groove 26D2 (FIGS. 1 and 2), or indeed puts the grooves 26D2 and 26L into communication by isolating them from the groove 26D1 (FIG. 3).

The bore zone 22 in which the spring 28 is arranged, between the slides 24 and 26, is connected to a leak-return duct that opens out into the radial face 16A of the internal distributor 16 and that communicates with the inside space of the casing in order to return leaks to a reservoir without any excess pressure. Specifically, the internal distributor presents a radial hole 38', that extends between the above-mentioned zone of the bore and the duct 38, which duct is oriented axially.

In FIG. 1, only the control chamber 24 is fed with control fluid. Consequently, the first slide 24 is moved in the direction F1, moving away from the lid 22A and moving towards the opposite end 22B of the bore 22. The slide 26 is likewise in its extreme position towards this end 22B of the bore, since the chamber 36 is not fed with fluid. For this purpose, thrust is exerted on the slide 26, by direct co-operation between the slides or by the force exerted by the spring 28. In this situation, it can be seen that the grooves 24D1 and 24L communicate with each other, the grooves 26D1 and 26L communicate with each other, and said four grooves communicate with the first main groove 18, while the grooves 24D2 and 26D2 communicate with the second main groove 20.

In FIG. 2, none of the control chambers 34 and 36 are fed with fluid, and the spring 28 pushes the slide 24 back towards the lid 22A in the direction F2, and also pushes the slide 26 towards the end 22B of the bore 22 in the direction F1. In this situation, the grooves 26D1 and 26L communicate with each other and, like the groove 24D1, they communicate with the first main groove 18, while the grooves 24D2 and 24L communicate with each other and, like the groove 26D2, they communicate with the second main groove 20.

In FIG. 3, only the chamber 36 is fed with fluid, and the slide 26 has moved in the direction F2 going away from the end 22B of the bore, the slide 24 being in its extreme position towards the lid 22A of the bore, by being pushed by the slide 26, directly or via the spring 28. In this situation, the grooves 24D1 and 26D1 communicate only with the main groove 18, while the grooves 24D2 and 24L communicate with each other and the grooves 26D2 and 26L communicate with each other, the four grooves 24D2, 24L, 26D2, and 26L communicating with the main groove 20.

The hydraulic machine may be considered as being composed of three sub-machines:

a first sub-machine comprising distribution ducts of a first primary group and of a second primary group;

a second sub-machine comprising distribution ducts of a first secondary group and of a second secondary group; and a third sub-machine comprising distribution ducts of a first tertiary group and of a second tertiary group.

By way of example:

The situation shown in FIG. 1 corresponds to a first cylinder capacity that is a large cylinder capacity, in which all three sub-machines are active, i.e. the distribution ducts of the first primary, secondary, and tertiary groups are all connected to the first main groove 18, while the distribution ducts of the second primary, secondary, and tertiary groups are all connected to the second main groove 20;

The situation shown in FIG. 2 is a second cylinder capacity corresponding to a medium cylinder capacity, in which only the first and second sub-machines are active, while the third sub-machine is inactive, i.e. the distribution ducts of the first primary and secondary groups are connected to the groove 18, while the distribution ducts of the second primary and secondary groups are connected to the second groove 20 and the distribution ducts of the first and second tertiary groups are connected to each other, e.g. by being connected to the second main groove 20; and The situation shown in FIG. 3 corresponds to a third cylinder capacity, which is a small cylinder capacity, in which only the first sub-machine is active, while the second and third sub-machines are inactive, i.e. the distribution ducts of the first primary group are connected to the first groove 18, the distribution ducts of the second primary group are connected to the second groove 20, while the distribution ducts of the first and second secondary groups are connected to each other and the distribution ducts of the first and second tertiary groups are likewise connected to each other (e.g. said ducts of the secondary and tertiary groups are all connected to the second main groove 20).

By way of example, the distribution ducts of the first primary group are all connected either to the groove 24D1 or to the groove 26D1, while the distribution ducts of the second primary group are all connected either to the groove 24D2 or to the groove 26D2. It may however be advantageous for some of the distribution ducts of the first primary group to be connected to the groove 24D1 (as for the duct 30), while the remaining portion is connected to the groove 26D1. In addition, it may be advantageous for some of the distribution ducts of the second primary group to be connected to the groove 24D2 while the remaining ducts are connected to the groove 26D2. The distribution ducts of the first secondary group may all be connected to the groove 26L, while the distribution ducts of the second secondary group may all be connected either to the groove 24D2 or to the groove 26D2 (or shared between the ducts connected to the groove 24D2 and to ducts connected to the groove 26D2). Finally and as for the duct 31, the distribution ducts of the first tertiary group may all be connected to the groove 24L, while the distribution ducts of the second tertiary group are all connected either to the groove 24D2 or to the groove 26D2 (or shared between the ducts connected to the groove 24D2 and to ducts connected to the groove 26D2).

Figure 5:
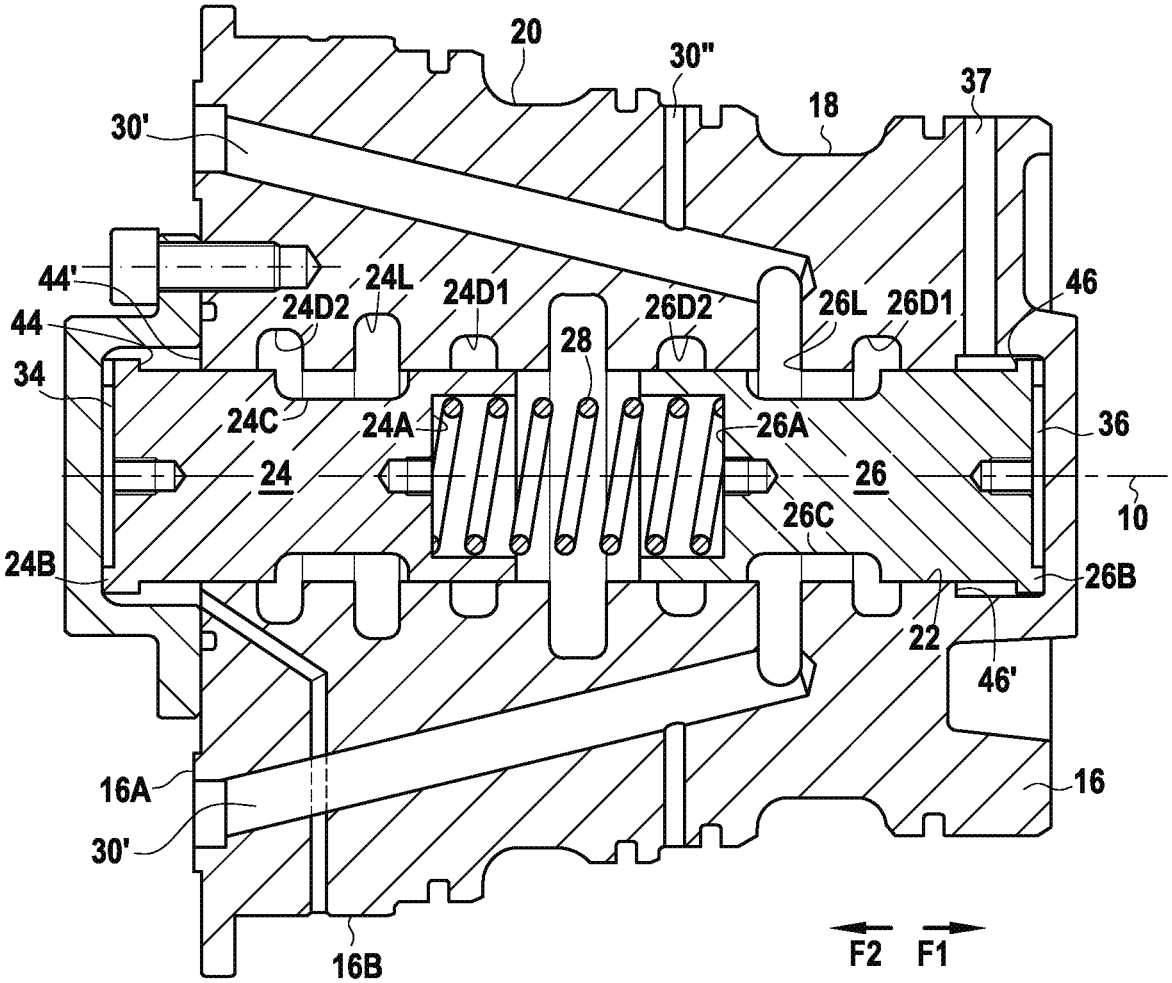
FIGS. 5 to 7 are views analogous to FIG. 4, showing respectively three other configurations of the slides.
Figure 6:
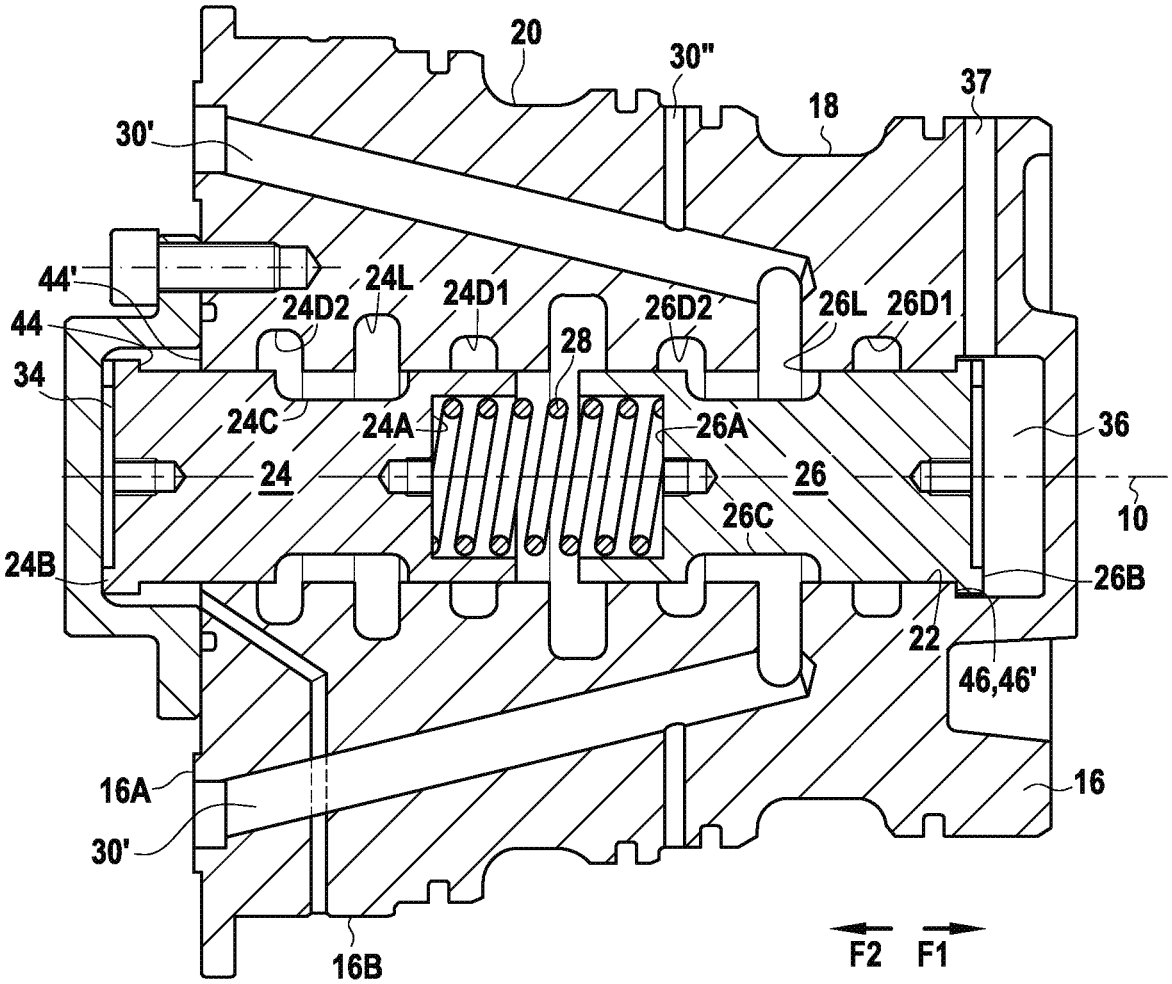
Figure 7:
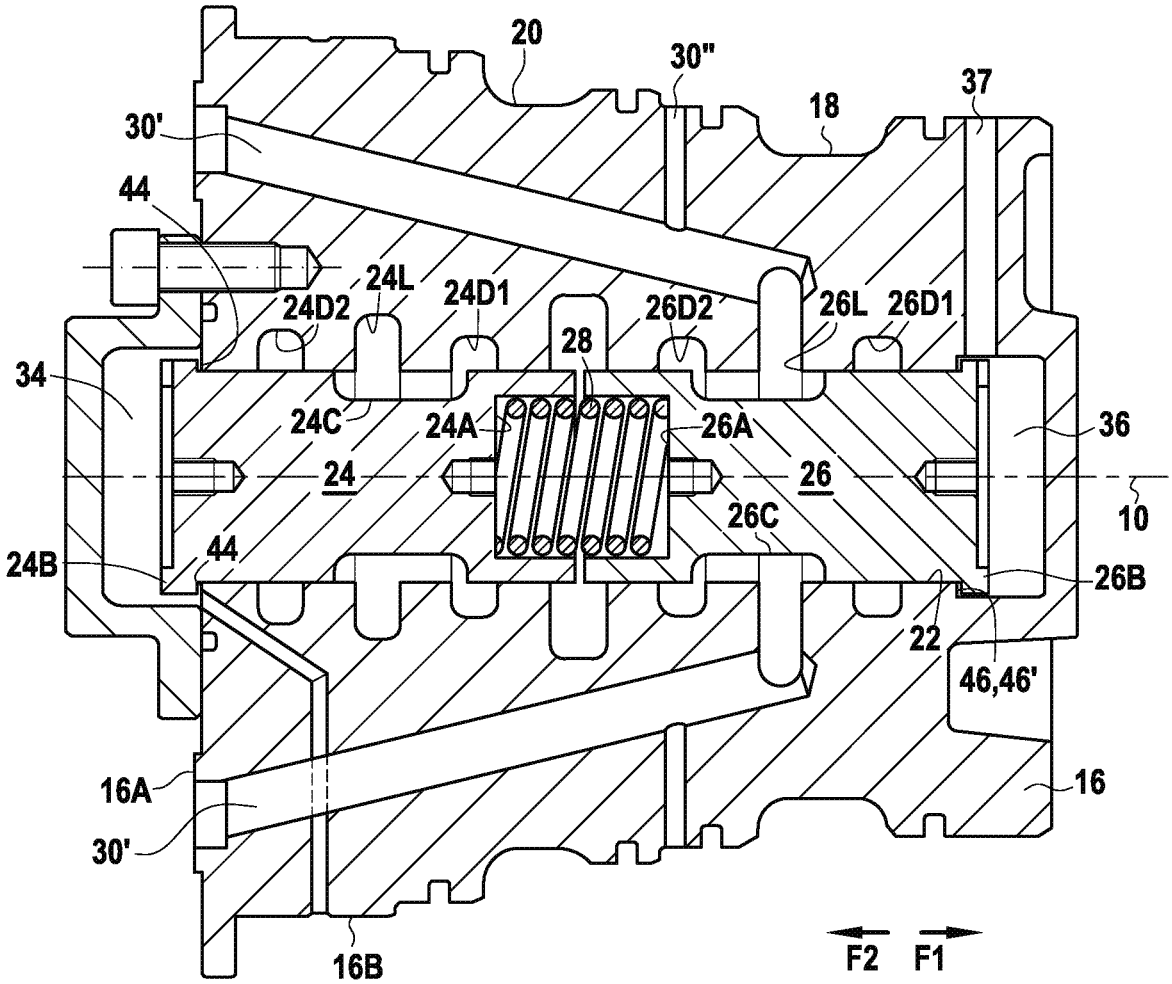

In the example shown, the distribution ducts of the second primary, secondary, and tertiary groups, are all connected permanently to one another and to the second main groove 20; the distribution ducts of the first tertiary group are also connected to this groove 20 when the third sub-machine is inactive (FIGS. 2 and 5); the distribution ducts of the first secondary group are also connected to said groove 20 when the second sub-machine is inactive (FIGS. 3, 6, and 7). This machine thus has a preferred direction of operation, in which the main groove 20 is connected to the fluid discharge.

There follows a description of FIGS. 4 to 7, which show an embodiment in which feeding a control chamber 34 or 36 gives rise to movement of only the corresponding slide, 24 or 26, without causing the other slide to move. In these figures, the same references are used as in FIGS. 1 to 3. This embodiment differs from that of FIGS. 1 to 3 by the fact that, for each slide, an abutment limits the movement of the slide while the corresponding control chamber is being fed.

More precisely, the slide 24 presents a shoulder 44 situated in this configuration towards its end 24B. When the control chamber 34 is fed with fluid, said shoulder 44 comes into abutment against an abutment surface 44' situated on a surface of the bore 22; in this configuration said surface is formed at the free end of said bore situated in the distribution face 16A. In addition, the slide 26 presents a shoulder 46 situated towards its end 26B, and when the control chamber 36 is fed with fluid, this abutment 46 comes into abutment against an abutment surface 46' made in the wall of the bore 22. Thus, the cylinder-capacity selector is capable of adopting four different configurations, corresponding to four distinct cylinder capacities.

Figure 4:
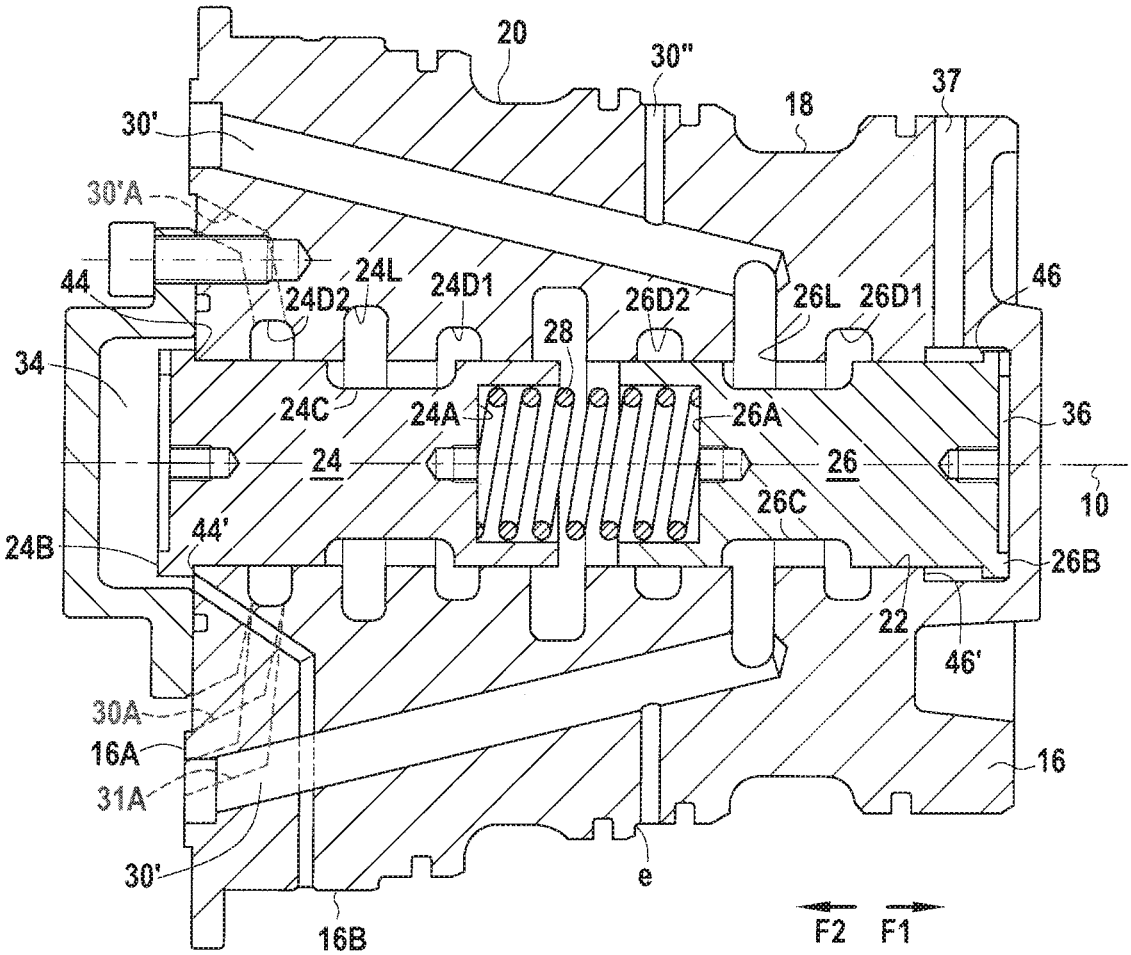
FIG. 4 is an axial section view of a distribution device in another embodiment, making it possible to obtain four distinct cylinder capacities and showing the slides of in a first configuration.

FIG. 4 shows the first configuration, which corresponds to that of FIG. 1, the chamber 34 being fed with fluid and the slide 24 thus being moved in the direction F1, while the slide 26 remains towards the end wall 22B of the bore, the control chamber 36 not being fed. The slide 24 has moved in the direction Fl until it reaches its shoulder 44, i.e. coming into abutment against the surface 44' of the bore. Communication between the various grooves is thus the same as in FIG. 1, in such a manner that all three of the above-mentioned sub-machines are active.

It should be observed that in FIG. 4 the axial section plane used is not exactly the same as that of FIGS. 1 to 3, in such a manner that two distribution ducts 30' can be seen that are connected to the connection groove 26L of the second segment of the bore 22 (e.g. they are thus distribution ducts of the first secondary group) and in such a manner that ducts 30" of reduced section can also be seen, connecting said distribution ducts to a zone of the outside axial surface 16B of the internal distributor 16 as defined between two gaskets (only the grooves for housing said gaskets being shown) by a shoulder e on which an axial thrust can thus be exerted in order to press the radial distribution face 16A against the communication face of the cylinder block.

Also illustrated in FIG. 4 are a distribution duct 30A of the second primary group, a distribution duct 30'A of the second secondary group, and a distribution duct 31A of the second tertiary group. The details of these connections of the various distribution ducts with the grooves 24D1, 24D2, 24L, 26D1, 26D2, and 26L have been previously discussed.

The configuration shown in FIG. 5 corresponds to that of FIG. 2, neither of the two control chambers 34 and 36 being fed with fluid, and the two slides being pushed back respectively towards the lid 22A and towards the end wall 26B of the bore. Communication between the various grooves is thus the same as in FIG. 2, in such a manner that only the first and second sub-machines are active.

The configuration of FIG. 6 corresponds to that of FIG. 3, the two slides being in their extreme positions in the direction of the arrow F2, only the chamber 36 being fed. In its movement in the direction F2, the slide 26 is stopped by its shoulder 46 coming into abutment with the abutment surface 46'. Communication between the various grooves is the same as in FIG. 3, in such a manner that only the first sub-machine is active.

FIG. 7 shows the additional configuration that can be obtained by means of the presence of the abutments, in which the two chambers 34 and 36 are fed with fluid, in such a manner that the slide 24 has moved in the direction Fl until the shoulder 44 comes into abutment with the surface 44', and the slide 26 has moved in the direction F2 until the shoulder 46' comes into abutment with the surface 46. In this configuration, the fluid connections of the grooves 24D1, 24L and 24D2 of the first segment of the bore are the same as in FIG. 1, while the fluid connections of the grooves 26D1, 26L and 26D2 are the same as in FIG. 3. In other words, the grooves 24D1 and 24L communicate with each other while being isolated from the groove 24D2, and the grooves 26D2 and 26L communicate with each other while being isolated from the groove 26D1. In this configuration, the first and third sub-machines are active while the second sub-machine is inactive. In this fourth configuration, the distribution ducts of the first primary and tertiary groups are connected to the groove 18, the distribution ducts of the second primary and tertiary groups are connected to the groove 20, and the distribution ducts of the first and second secondary groups are connected to each other, in this configuration by being connected to the second groove 20.

Figure 8:
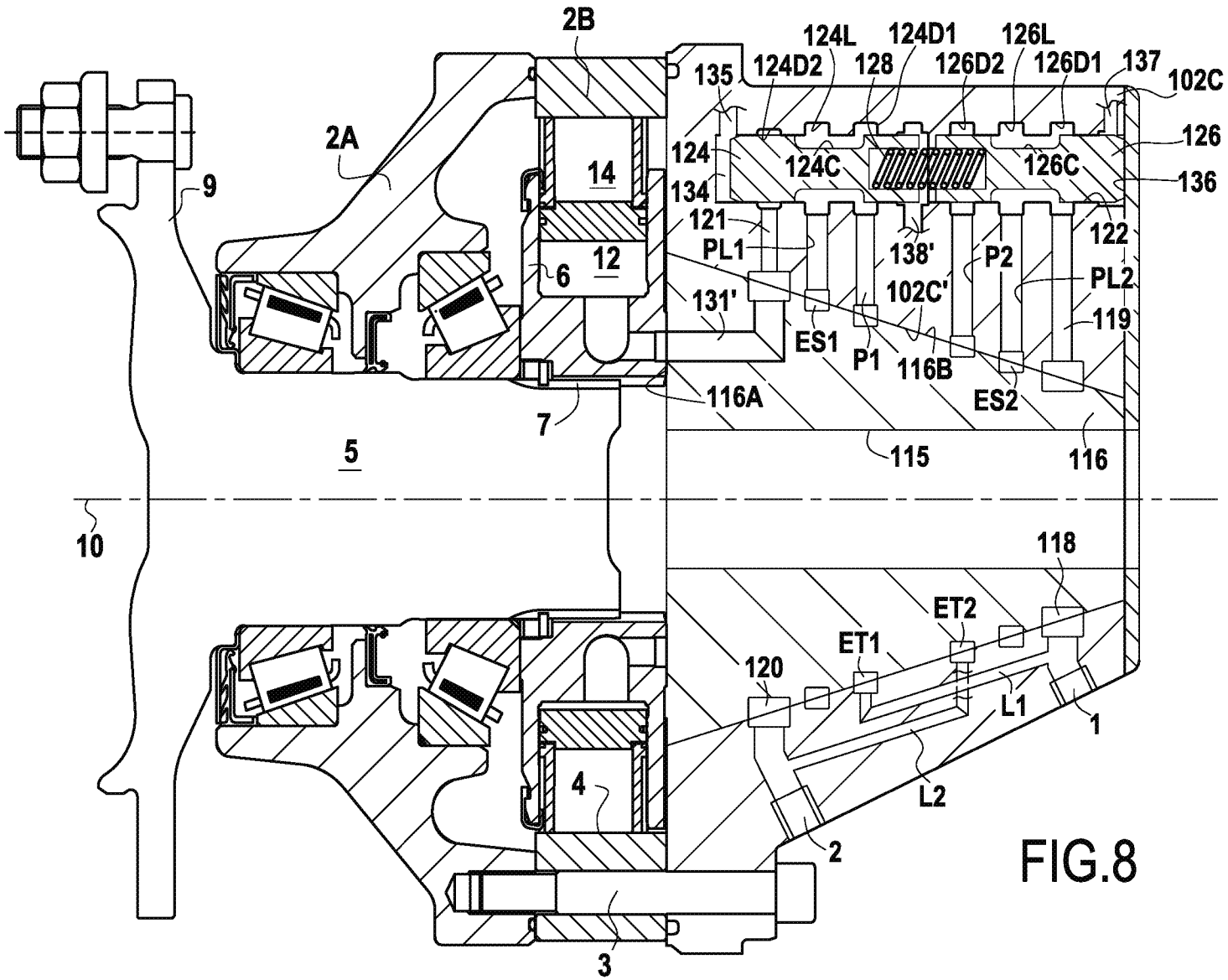
FIG. 8 is an axial section view of a hydraulic machine comprising a distribution device of the invention in a second embodiment.

A description follows of FIG. 8, in which the elements that are unchanged relative to FIGS. 1 to 3 are given the same references as in those figures, while the other elements are given the same references plus 100.

As for FIGS. 1 to 3, the machine of FIG. 8 is of the type having a stationary casing and a rotary cylinder block; its internal distributor 116 is engaged in the distributor-counterpart 102C, which forms a portion of the casing 2A, 2B, and 102C. Unlike the machine shown in FIGS. 1 to 3, the machine shown in FIG. 8 has its cylinder-capacity selector arranged in the portion 102C of the casing and not in its internal distributor 116 which, in this configuration, is hollow. Thus, the axial hollow 115 of the distributor 116 may for example serve to house a brake shaft (not shown).

In FIG. 8, the cylinder-capacity selector is housed in a bore 122 of the portion 2C of the casing that, for this purpose, may present a radial extension. Thus, the bore 122 is offset relative to the axis 10 of the machine. In this configuration, the bore 122, the two slides 124 and 126, and the spring 128 of the cylinder-capacity selector, are analogous to the bore 22, the slides 24 and 26 and the spring 28 of FIGS. 1 to 3. Abutments analogous to those that are described with reference to FIGS. 4 to 7 may also be provided.

The distribution grooves and the connection grooves 124D2, 124L, 124D1, 126D2, 126L, and 124D1 are organized like the grooves 24D2, 24L, 2D1, 26D2, 26L, and 26D1 of the preceding figures. The bore zone 122 between the slides 124 and 126 is connected to a leak return duct, e.g. by a radial hole the beginning 138' of which can be seen. The control chambers 134 and 136 are arranged like the control chambers 34 and 36 and, like them, they are fed by respective control ducts 135 and 137.

A first main enclosure 118, which is connected to the first main duct 1, is made between the inner axially-extending face 102C' of the distributor-counterpart 102C and the outer axially-extending face 116B of the distributor 116, which face each other. A second main enclosure 120, which is connected to the second main duct 2, is also made between these facing axially-extending faces 102C' and 116B. The distribution grooves 124D1 and 126D1 are connected permanently to the first main enclosure 118, and the distribution grooves 124D2 and 126D2 are connected permanently to the second main enclosure 120. The main enclosures 118 and 120 are defined by respective grooves in the axial face 102C' and the axial face 116B, which are in register. In this configuration, the distribution grooves 124D2 and 126D1 are connected respectively to the main enclosures 120 and 118 by respective radial holes 121 and 119 in the distributor-counterpart 102C; the distribution groove 124D1 is connected by a hole P1 in the distributor-counterpart to the buffer enclosure ET1, which is provided between the faces 102C' and 116B and which is connected to the enclosure 118 by a first connection hole L1 in the distributor-counterpart; and the distribution groove 126D2 is connected by a hole P2 in the distributor-counterpart to a buffer enclosure ET2, which is provided between the faces 102C' and 116B and is connected to the enclosure 120 by a second connection hole L2 in the distributor-counterpart. Thus, the first distribution grooves 124D1 and 126D1 are connected to each other by the first connection hole L1 in the distributor-counterpart formed by the portion of the casing 102C, and the second distribution grooves 124D2 and 126D2 are connected to each other by the second hole L2 in said portion of the casing.

The first connection groove 124L is connected by a hole PL1 in the distributor-counterpart to a first secondary enclosure ES1 provided between the faces 102C' and 116B, and the second connection groove 126L is connected by a hole PL2 in the distributor-counterpart to a second secondary enclosure ES2 provided between the faces 102C' and 116B.

Like the duct 131', the distribution ducts open out into the radial distribution face 116A of the distributor 116 and they are connected, in groups, to the enclosures 118, 120 (and, possibly ET1, ET2), ES1 and ES2 that are described above.

As in the preceding figures, there are also three sub-machines:

a first sub-machine comprising the distribution ducts of the first primary group, which are connected to the first distribution grooves 124D1 and 126D1 via the enclosures 118 and ET1, and the distribution ducts of the second primary group, which are connected to the second distribution grooves 124D2 and 126D2 via the enclosures 120 and ET2;

a second sub-machine comprising the distribution ducts of the first secondary group, which are connected to the connection groove 126L via the enclosure ES2, and the distribution ducts of the second primary group, which are connected to the second distribution grooves 124D2 and 126D2 via the enclosures 120 and ET2; and a third sub-machine comprising the distribution ducts of the first tertiary group, which are connected to the connection groove 124L via the enclosure ES1, and the distribution ducts of the second tertiary group, which are connected to the second distribution grooves 124D2 and 126D2 via the enclosures 120 and ET2.

The three or even the four cylinder capacities of the machine are thus selected as described with reference to FIGS. 1 to 7, it being specified that, in this configuration, the machine has a preferred direction of operation.

Figure 9:
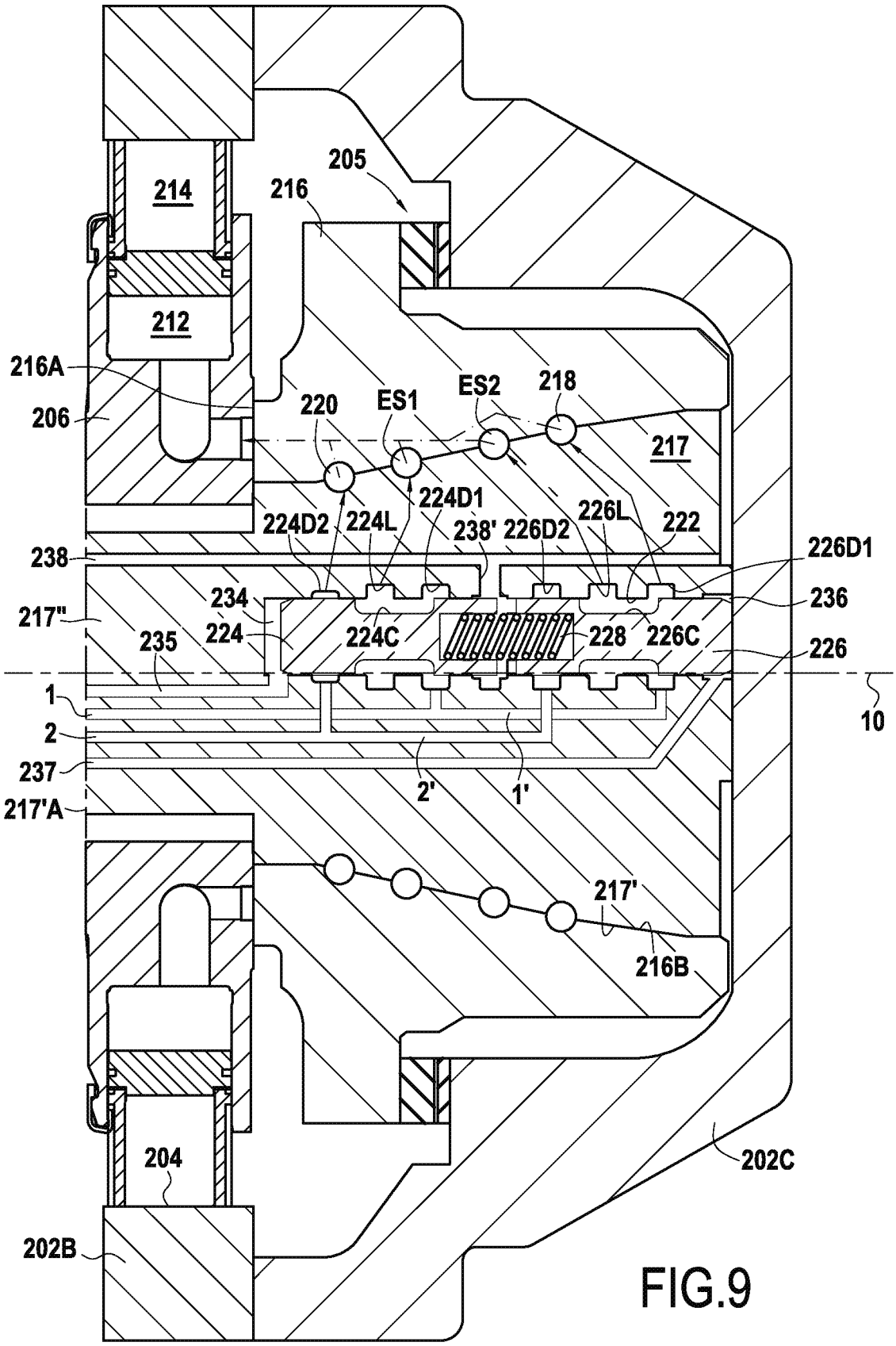
FIG. 9 is a fragmentary view in axial section of a hydraulic machine comprising a distribution device of the invention in a third embodiment.

There follows a description of FIG. 9, which shows an example embodiment for a machine having a non-rotary cylinder block and a rotary casing, the distributor also being rotary.

FIG. 9 is a view partially in section. It shows only the elements that are essential to understanding. The cylinder block 206 presents radial cylinders 212 in which pistons 214 are mounted to move radially back and forth against the cam 204, itself formed in a portion of the casing 202B. The fluid distributor and the cylinder-capacity selector are housed in a portion of the casing 202C. The distributor 216 is constrained to rotate with said casing portion 202C by any suitable means, e.g. by means of a connection 205 of the Oldham coupling type between facing radial faces of the distributor 216 and of said casing portion 202C. The distributor-counterpart 217 is engaged in the distributor 216 and thus forms a core that, like the cylinder block, is not rotary. The inner axially-extending face 216B of the distributor 216 faces the outer axially-extending face 217' of the distributor-counterpart 217 and turns relative thereto.

The bore 222 of the cylinder-capacity selector is made in the distributor-counterpart 217; in this configuration this bore is centered on the axis 10 of rotation of the machine (i.e., the axis of rotation of the distributor and of the casing of the machine). The bore 222 presents distribution grooves and connection grooves 224D2, 224L, 224D1, 226D2, 226L and 224D1, which are organized respectively like the grooves 24D2, 24L, 2D1, 26D2, 26L, and 26D1 described with reference to the FIGS. 1 to 3. Slides 224 and 226 and a spring 228, respectively analogous to the slides 24, 26 and to the spring 28, are arranged in the bore 222. The zone of said bore between the slides 224 and 226 is connected to a leak return duct 238, e.g. by a radial hole 238'. Control chambers 234 and 236, arranged like the control chambers 34 and 36 are, like those chambers, fed by respective control ducts 235 and 237.

The first distribution grooves 224D1 and 226D1 are connected permanently to each other (by a hole 1' in the distributor-counterpart) and to the first main duct 1, while the second distribution grooves 224D2 and 226D2 are connected permanently to each other (by a hole 2' in the distributor-counterpart) and to the second main duct 2. In addition, the first distribution groove 226D1 is connected to a first main enclosure 218, by a hole in the distributor-counterpart represented diagrammatically by an arrow in the figure. In addition, the second distribution groove 224D2 is connected to a second main enclosure 220 by holes in the distributor-counterpart shown diagrammatically by an arrow. The first main enclosure 218 is thus connected permanently to the first main duct 1 and to the first distribution grooves, while the second main enclosure 220 is connected permanently to the second main duct 2 and to the second distribution grooves.

The first connection groove 224L is connected to a first secondary enclosure ES1 and the second connection groove 226L is connected to a second secondary enclosure ES2, these secondary enclosures being provided between the opposite axially-extending faces 217' and 216B.

The distribution ducts open into the radial distribution face 216A of the distributor 216 and they are connected, in groups, to the enclosures 218, 220, ES1, and ES2.

The respective permanent connections between the distribution grooves and the main ducts are provided by means of the respective holes 1' and 2' in the distributor-counterpart 217, which open out onto a communication face 217'A thereof. In this configuration, this communication face 217'A is situated at the end of the distributor-counterpart 217 beside the cylinder block 206. The connection of the distributor to the main ducts thus takes place via a core 217" of the machine, which forms a stator and passes to the inside of the cylinder block. By way of example, if the machine is a motor for driving a wheel, its casing can form a portion of the hub of the wheel, and said core 217" may be the spindle of the wheel. In addition, in this configuration, the control ducts 235 and 237 that serve to feed the control chambers 234 and 236 pass via said core 217".

As in the preceding figures, the distribution grooves 224D1 and 224D2 may be selectively connected to the connection groove 224L by a communication groove 224C of the slide 224, and similarly the distribution grooves 226D1 and 226D2 may be connected selectively to the connection groove 226L by a communication groove 226C of the slide 226; the respective positions of said slides are controlled by the control chambers 234 and 236, it also being specified that the slides can have abutments of the type described with reference to FIGS. 4 to 7, in order to be able to adopt four relative positions.

Thus, as in the preceding figures, there are also three sub-machines:

a first sub-machine comprising the distribution ducts of the first primary group, which are connected to the first distribution grooves 224D1 and 226D1 via the first main enclosure 218, and the distribution ducts of the second primary group, which are connected to the second distribution grooves 124D2 and 126D2 via the second main enclosure 220;

a second sub-machine comprising the distribution ducts of the first secondary group, which are connected to the connection groove 226L via the enclosure ES2, and the distribution ducts of the second secondary group, which are connected to the second distribution grooves 224D2 and 226D2 via the second main enclosure 220; and a third sub-machine comprising the distribution ducts of the first tertiary group, which are connected to the connection groove 224L via the first secondary enclosure ES1, and the distribution ducts of the second tertiary group, which are connected to the second distribution grooves 224D2 and 226D2 via the second main enclosure 220.

The selection of the three or even four cylinder capacities of the machine is thus performed as described with reference to FIGS. 1 to 7, given that, in this configuration, the machine has a preferred direction of operation.

We claim:

1. A distribution device for a hydraulic machine comprising a distributor having a central axis extending therethrough and presenting distribution ducts opening out into a radial distribution face, and a distributor-counterpart, wherein each of the distributor and distributor-counterpart is an element and wherein one element is engaged in the other of said elements, in such a manner that said elements present respective opposite axially-extending faces between which first and second main enclosures are provided, the device comprising first and second cylinder-capacity selection slides arranged one after the other in a bore of one of the elements constituted by the distributor and by the distributor-counterpart, which bore is connected to the main enclosures and to at least some of the distribution ducts, said slides being configured to adopt at least three distinct configurations establishing different connections between main ducts and the distribution ducts via the main enclosures, thus defining at least three distinct operating capacities associated with the at least three distinct configurations.

2. The device as claimed in claim 1, wherein the bore is arranged axially and the slides are movable axially within the bore in order to define said distinct configurations.

3. The device as claimed in claim 2, wherein the bore is formed in whichever of the distributor or the distributor-counterpart is engaged in the other of the distributor or the distributor-counterpart.

4. The device as claimed in claim 3, wherein the bore is centered about the central axis.

5. The device as claimed in claim 1, including a spring, arranged between opposite faces of the two slides for permanently biasing relative movement of the slides.

6. The device as claimed in claim 5, wherein the spring is arranged in a zone of the bore that is connected to a leak return duct.

7. The device as claimed in claim 5, wherein for each of the two slides, the device comprises an abutment that is suitable for co-operating with each slide in order to limit the movement of that slide toward the other slide, regardless of the position of the other slide.

8. The device as claimed in claim 5, comprising a first control chamber for the first slide and a second control chamber for the second slide, each control chamber being suitable for being fed with fluid in order to control selectively a controlled movement of the respective slide in a direction opposite to said relative movement of that slide.

9. The device as claimed in claim 8, wherein the control chambers are arranged at the respective ends of the slides, opposite the spring.

10. The device as claimed in claim 1, wherein the distributor is engaged in the distributor-counterpart that forms a casing portion of the device.

11. The device as claimed in claim 10, wherein the bore is formed in the distributor-counterpart.

12. The device as claimed in claim 1, wherein the first and second slides are arranged in respective first and second segments of the bore, each of the first and second segments of the bore comprising a first distribution groove connected to the first main enclosure and a second distribution groove connected to the second main enclosure, each of the first and second segments of the bore comprising a connection groove suitable for being connected to one of the first and the second distribution grooves of the segment depending on the position of the slide situated in said segment; and wherein, among the distribution ducts, distinct groups of distribution ducts are connected respectively to the connection grooves and to the distribution grooves.

13. The device as claimed in claim 12, wherein the distributor is constrained not to move in rotation relative to the distributor-counterpart, the bore is formed in the distributor, and the first distribution groove of the first segment of the bore and the first distribution groove of the second segment of the bore are connected to each other by a first hole in the distributor and the second distribution groove of the first segment of the bore and the second distribution groove of the second segment of the bore are connected to each other by a second hole in the distributor.

14. The device as claimed in claim 12, wherein the distributor is constrained not to move in rotation relative to the distributor-counterpart, the bore is formed in the casing portion in which the distributor is engaged, and the first distribution groove of the first segment of the bore and the first distribution groove of the second segment of the bore are connected to each other by a first hole in the distributor, and the second distribution groove of the first segment of the bore and the second distribution groove of the second segment of the bore are connected to each other by a second hole in said casing portion.

15. The device claimed in claim 1, wherein the first and second slides are arranged in respective first and second segments of the bore, each of the first and second segments of the bore comprising a first distribution groove connected to a first one of the main ducts and a second distribution groove connected to a second one of the main ducts; each of the first and second segments of the bore comprising a connection groove suitable for being connected to one of the first and second distribution grooves of the segment depending on the position of the slide situated in said segment; and wherein, among the distribution ducts, distinct groups of distribution ducts are connected respectively to the connection grooves and to the distribution grooves.

16. The device as claimed in claim 15, wherein the distributor rotates with respect to the distributor-counterpart, the bore is formed in the distributor-counterpart, which is engaged in the distributor, and the first distribution groove of the first segment of the bore and the first distribution groove of the second segment of the bore are connected to each other by a first hole in the distributor-counterpart connected to the first main duct and the second distribution groove of the first segment of the bore and the second distribution groove of the second segment of the bore are connected to each other by a second hole in the distributor-counterpart connected to the second main duct.

17. The device as claimed in claim 15, wherein first and second secondary enclosures, provided between a respective opposite axially-extending faces of the distributor and the distributor-counterpart, are connected respectively to the first and second connection grooves.

18. The device as claimed in claim 12, wherein, for each of the first and second segments of the bore, the connection groove is situated between the first and second distribution grooves, and each of the first and second slides presents a communication groove in order to put the connection groove into communication with the first or the second distribution groove depending on a position of the slide.

19. The device as claimed in claim 1, wherein the distribution ducts are distributed in first and second primary groups, first and second secondary groups, and first and second tertiary groups, and the at least three distinct operating cylinder capacities comprise: a first cylinder capacity in which the distribution ducts of the first primary, first secondary, and first tertiary groups are connected to a first one of the main ducts while the distribution ducts of the second primary, second secondary, and second tertiary groups are connected to a second one of the main ducts; a second cylinder capacity in which the distribution ducts of the first primary and first secondary groups are connected to the first main duct, the distribution ducts of the second primary and second secondary groups are connected to the second main duct, and the distribution ducts of the first and second tertiary groups are connected to each other; and a third cylinder capacity in which the distribution ducts of the first primary group are connected to the first main duct, the distribution ducts of the second primary group are connected to the second main duct, and the distribution ducts of the first and second secondary groups are connected to each other and the distribution ducts of the first and second tertiary groups are connected to each other.

20. The device as claimed in claim 19, wherein the at least three distinct operating cylinder capacities further comprise a fourth operating cylinder capacity in which the distribution ducts of the first primary and first tertiary groups are connected to the first main duct, the distribution ducts of the second primary and second tertiary groups are connected to the second main duct, and the distribution ducts of the first and second secondary groups are connected to each other.

21. The device as claimed in claim 19, wherein, in the third cylinder capacity, the distribution ducts of the first and second secondary groups and the distribution ducts of the first tertiary and second tertiary groups are connected to the second main duct, and in the second cylinder capacity, the distribution ducts of the first tertiary and second tertiary groups are connected to the second main duct.

22. The device as claimed in claim 19, wherein the distribution ducts belonging to the second primary group, the second secondary group, and the second tertiary group, respectively are connected to each other, regardless of the configuration of the slides.

23. A device according to claim 22, wherein the first and second slides are arranged in respective first and second segments of the bore, each of the first and second segments of the bore comprising a first distribution groove connected to the first main enclosure and a second distribution groove connected to the second main enclosure, each of the first and second segments of the bore comprising a connection groove suitable for being connected to one of the first and second distribution grooves of a segment under consideration depending on the position of the slide situated in said segment; wherein, among the distribution ducts, distinct groups of distribution ducts are connected respectively to the connection grooves and to the distribution grooves; and wherein the distribution ducts of the first primary group are connected to the first distribution groove of at least one of the first and second segments of the bore, the distribution ducts of the second primary, second secondary, and second tertiary groups are connected to the second distribution groove of at least one of the first and second segments of the bore, the distribution ducts of the first tertiary group are connected to the connection groove of the first segment, and the distribution ducts of the first secondary group are connected to the connection groove of the second segment.

24. A device as claimed in claim 22, wherein the first and second slides are arranged in respective first and second segments of the bore, each of the first and second segments of the bore comprising a first distribution groove connected to the first one of the main ducts and a second distribution groove connected to a second one of the main ducts; each of the first and second segments of the bore comprising a connection groove suitable for being connected to one of the first and second distribution grooves of the segment depending on the position of the slide situated in said segment; wherein, among the distribution ducts, distinct groups of distribution ducts are connected respectively to the connection grooves and to the distribution grooves; and wherein the distribution ducts of the first primary group are connected to the first distribution groove of at least one of the first and second segments of the bore, the distribution ducts of the second primary, second secondary, and second tertiary groups are connected to the second distribution groove of at least one of the first and second segments of the bore, the distribution ducts of the first tertiary group are connected to the connection groove of the first segment, and the distribution ducts of the first secondary group are connected to the connection groove of the second segment.

25. The device as claimed in claim 23, wherein the distribution ducts of the first primary group comprise at least one duct opening out into the first distribution groove of the first segment of the bore and at least one duct opening out into the first distribution groove of the second segment of the bore.

26. The device as claimed in claim 23, wherein the distribution ducts of the second primary, second secondary, and second tertiary groups comprise at least one duct opening out into the second distribution groove of the first segment of the bore and at least one duct opening out into the second distribution groove of the second segment of the bore.

27. A hydraulic machine comprising a cam, a cylinder block having cylinders in which the pistons are movable back and forth in order to co-operate with the cam, and a distribution device as claimed in claim 1, the cylinder block being suitable for turning relative to the cam about an axis of rotation and the distributor being secured to the cam with regard to the rotation about the axis of rotation, the cylinder block presenting a radial communication face in which are located communication orifices connected to the cylinders and suitable for communicating sequentially with the distribution ducts during the relative rotation of the cylinder block and of the cam.

28. The device as claimed in claim 20, wherein, in the fourth operating cylinder capacity, the distribution ducts for all of the first and second secondary groups are connected to the second main duct.

* * * * *